US006598785B2

(12) United States Patent
Quaintance

(10) Patent No.: US 6,598,785 B2
(45) Date of Patent: Jul. 29, 2003

(54) CONTAINER WITH IMPROVED STACKING STRENGTH AND RESISTANCE TO LATERAL DISTORTION

(75) Inventor: Benjamin Quaintance, Germantown, TN (US)

(73) Assignee: International Paper Company, Tuxedo, NY (US)

( * ) Notice: Subject to any disclaimer, the term of this patent is extended or adjusted under 35 U.S.C. 154(b) by 0 days.

(21) Appl. No.: 10/205,111

(22) Filed: Jul. 25, 2002

(65) Prior Publication Data

US 2003/0019920 A1 Jan. 30, 2003

Related U.S. Application Data

(60) Provisional application No. 60/307,681, filed on Jul. 25, 2001.

(51) Int. Cl.[7] ..... B65D 5/20; B65D 21/032

(52) U.S. Cl. ..... 229/191; 229/108; 229/109; 229/110; 229/918

(58) Field of Search ..... 229/108, 109, 229/110, 191, 906, 915, 918

(56) References Cited

U.S. PATENT DOCUMENTS 1,482,727 A * 2/1924 Borchers ..... 229/110
3,610,514 A * 10/1971 Samsing ..... 229/108
3,918,630 A * 11/1975 Meyers ..... 229/191
4,056,223 A * 11/1977 Williams ..... 229/918
4,151,948 A * 5/1979 de la Fuente, Jr. ..... 229/918
4,417,686 A * 11/1983 Wozniacki ..... 229/191
4,850,527 A * 7/1989 Church et al. ..... 229/110
5,586,716 A * 12/1996 Correll ..... 229/110
5,752,648 A * 5/1998 Quaintance ..... 229/918
5,755,377 A * 5/1998 Durand ..... 229/110

FOREIGN PATENT DOCUMENTS

DE 3933372 A1 * 4/1991 ..... 229/191

* cited by examiner

*Primary Examiner*—Gary E. Elkins
(74) *Attorney, Agent, or Firm*—Dennis H. Lambert

(57) ABSTRACT

A container made from corrugated paperboard has more than four sides and is constructed to resist distortion when force is applied to the ends or sides of the container, and also to resist crushing when containers are stacked on top of one another. In one embodiment, the container has six sides, with two side walls, two end walls, and two diagonally opposed diagonal corner panels and two diagonally opposed square corners. In another embodiment, the container has seven sides, with two side walls, two end walls, and three diagonal corner panels and one square corner. In a further embodiment, the container has eight sides, with two side walls, two end walls, and four diagonally opposed diagonal corner panels. In this embodiment, the diagonal corner panels are oriented so that they subtend an angle of from about 35° to about 40°, and preferably 38°, with respect to the longitudinal axis of the container. The diagonal corner panels in the other embodiments may also be oriented at 38°, or from about 35° to about 40°.

9 Claims, 10 Drawing Sheets

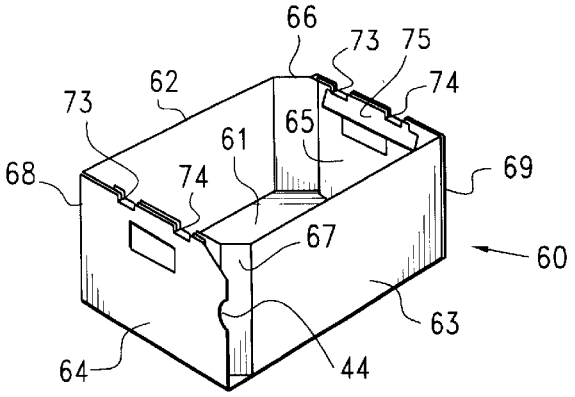
FIG.7
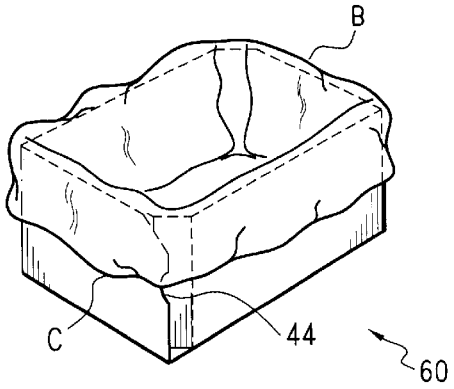
FIG.9
FIG.8
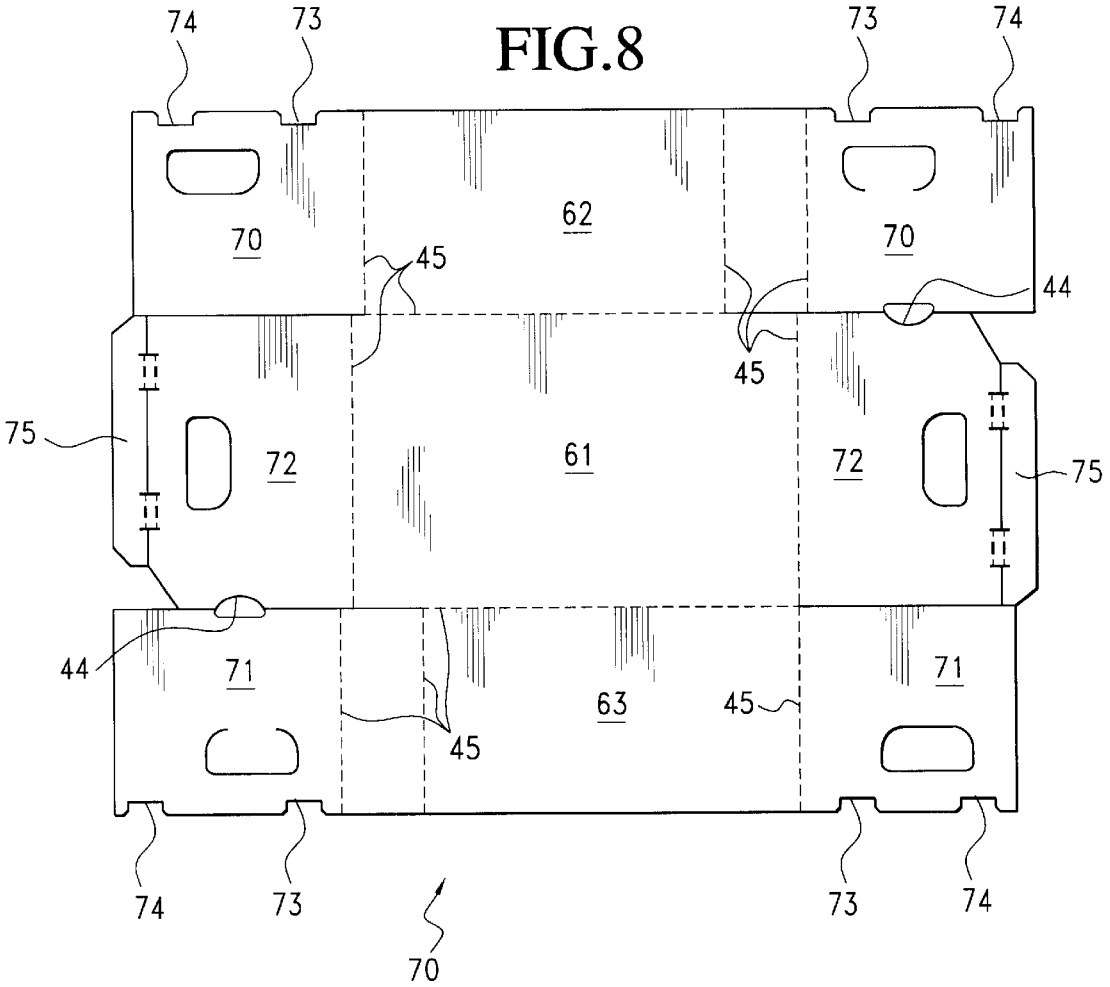

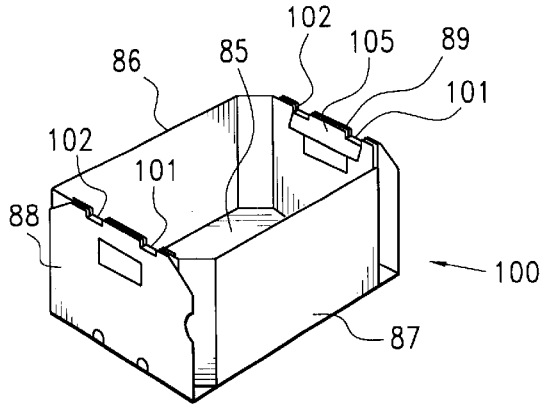
FIG.13
FIG.14
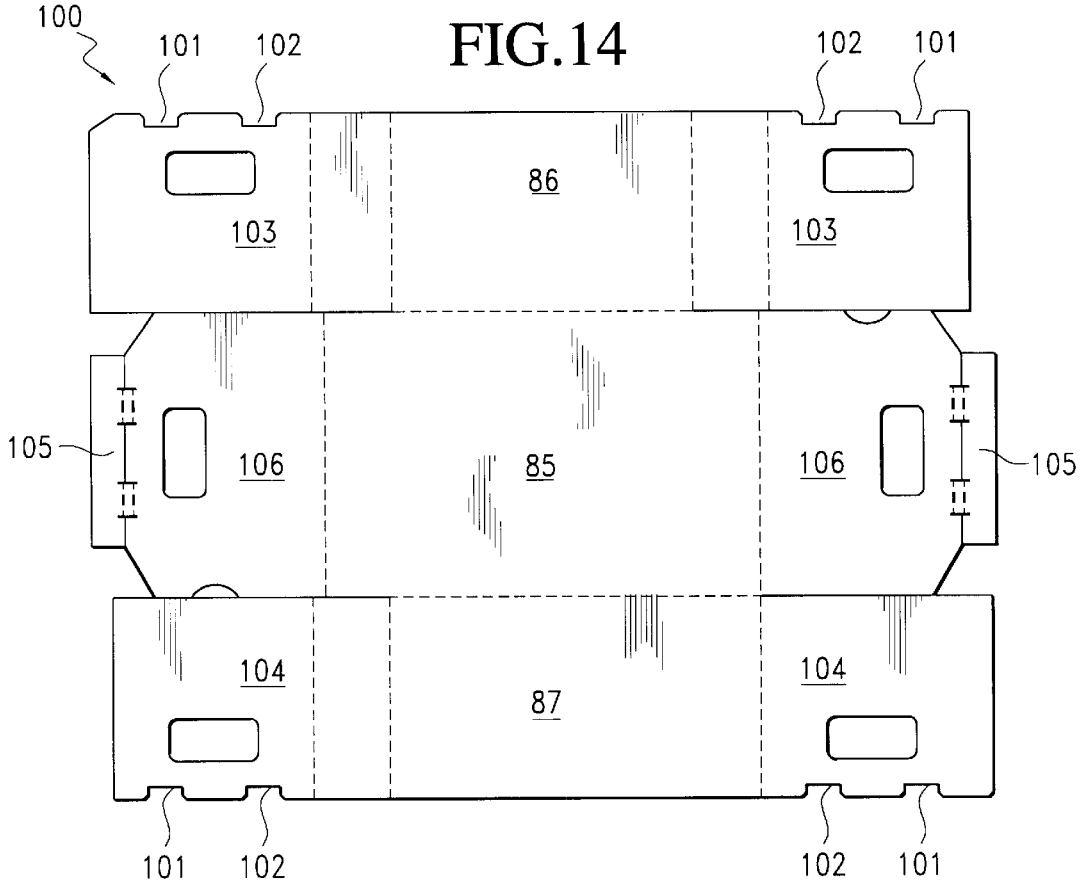

CONTAINER WITH IMPROVED STACKING STRENGTH AND RESISTANCE TO LATERAL DISTORTION

This application claims the benefit of U.S. Provisional Application No. 60/307,681, filed Jul. 25, 2001, entitled "Poultry Pack".

BACKGROUND OF THE INVENTION

1. Field of the Invention

This invention relates to packaging. More specifically, the invention relates to a multi-sided container or box made of corrugated paperboard. In particular, the invention relates to a corrugated paperboard tray for containing poultry products, wherein the tray has improved stacking strength and resistance to distortion from lateral forces applied to the sides or ends of the tray.

2. Prior Art

Various styles of paperboard boxes are known in the prior art for containing a variety of products. Conventional boxes may have four sides and be square or rectangular in plan view, or they may have eight sides, with opposed pairs of parallel side and end walls and diagonal corner panels oriented at 45° to the longitudinal axis of the box and connecting adjacent side and end walls.

Examples of prior art eight sides boxes or trays are disclosed in applicant's prior patents Des. 361,892 and 5,752,648. These boxes are designed for containing poultry pieces packed in ice, and are usually termed poultry trays. They are formed from a unitary blank of corrugated paperboard, and are sometimes coated on both sides with wax or other material to impart rigidity and resistance to water degradation. The diagonal corner panels subtend an angle of 45° with respect to the longitudinal axis of the box.

Eight sided trays have greater compressive strength when stacked on top of one another, and exhibit less side wall bulge from the weight of the contents therein, than do four sided trays. However, because of the diagonally oriented corner panels, an eight sided tray tends to flex or distort, especially at the open top edge, when lateral force is applied to the sides or ends of the tray, as occurs for example when two eight sided trays are pushed together end-to-end during stretch wrapping of the trays to form a unit load. This distortion of the tray can result in dislodgement of the cover which is usually applied to the tray, or make it difficult to apply a cover. Additionally, these changes in dimension of the tray may cause other difficulties when the trays are palletized during shipment and/or storage. Additionally, there are no square corners on an eight sided tray around which a label can be wrapped so that it is visible from each of two adjacent sides.

Accordingly, there is need for a tray that has superior stacking strength and resistance to distortion when transverse forces are applied to the ends or sides of the tray.

SUMMARY OF THE INVENTION

The tray of the invention has stacking strength superior to a four sided container, and resistance to distortion superior to an eight sided container when transverse forces are applied to the ends of the tray.

In one embodiment of the invention, for a tray having diagonal corner panels, the diagonal corner panels are oriented from about 35° to about 40°, and in a preferred embodiment 38°, with respect to the longitudinal axis of the tray. The shallower angle of the corner panels, compared with the conventional 45° angle, changes the resultant force vector slightly toward the ends of the tray, increasing resistance to distortion from force applied to the ends of the tray. The shallower angle of the corner panels also results in wider corner panels and concomitant shorter side panels, with comparable or even improved stacking strength over similarly sized eight sided trays with the diagonal corner panels oriented at 45°. These beneficial results are obtained in trays having six, seven or eight sides, for example, with two, three or four diagonal corner panels, respectively.

In an alternate embodiment, for a tray having diagonal corner panels, at least one corner of the tray is squared. Thus, an eight sided tray, for example, is modified to have one square corner, producing a seven sided tray, or two diagonally opposite corners are made square to produce a six sided tray. The remaining diagonal corner panels may be oriented at any angle, including 38° or 45° relative to the longitudinal axis of the tray, although if oriented at 38° some of the benefits discussed above can be additionally obtained. Although the seven sided tray resists distortion caused by lateral force applied to the side or end of the tray, the resistance is not as great as that provided by the six sided tray. Both the six sided tray and the seven sided tray provide a square corner around which a label can be wrapped so that it is visible from two adjacent sides of the tray. The seven sided tray can be formed from the same blank size as the standard eight sided package, and neither its machine nor manual assembly is any more complicated than the standard eight sided package. Further, the top to bottom compression resistance of the seven sided tray is 10% to 25% greater than a standard four sided tray.

In the six sided tray, the two diagonal corner panels not squared are lengthened approximately 30% as compared with a conventional eight sided tray of comparable size. The longer diagonal corner panels increase the top to bottom compression strength of the six sided tray so that it is about the same as a similar size eight sided tray. This compression performance of the six sided tray was unexpected. Moreover, better fit of the cover was obtained because of the two diagonally opposed square corners. Further, machine conversion from four sided to six sided is easier than from four sided to eight sided. The six sided tray may be adapted for either machine set up or manual set up.

The invention is a simple, economical and effective way to maintain stacking strength and improve resistance to distortion from force applied laterally to the sides or ends of trays having diagonal corner panels. Trays incorporating the invention, whether orienting the diagonal corner panels at 38°, or squaring at least one corner, or both, can be produced and generally handled with existing machinery.

BRIEF DESCRIPTION OF THE DRAWINGS

The invention is described in greater detail hereinafter with reference to the drawings, wherein like reference characters designate like parts throughout the several views, and wherein:

FIG. 7 is a top perspective view of a second modification of the first embodiment, in which the six sided container is configured for manual set up.

FIG. 8 is a plan view of a blank for making the tray of FIG. 7.

FIG. 9 is a top perspective view depicting the six sided container having a plastic bag in place for receiving product.

FIG. 13 is a top perspective view of a first modification of the second embodiment, in which the seven sided tray is configured for manual set up.

FIG. 14 is a plan view of a blank for making the tray of FIG. 13.

DETAILED DESCRIPTION OF THE PREFERRED EMBODIMENTS

Figure 1:
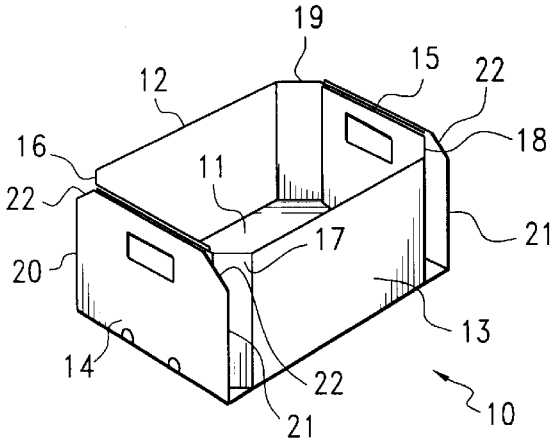
FIG.1 (PRIOR ART)
FIG. 1 is a top perspective view of a conventional eight sided poultry tray, in which opposed pairs of parallel side and end walls are joined by diagonal corner panels extending at 45° in each of the corners of the tray.
Figure 2:
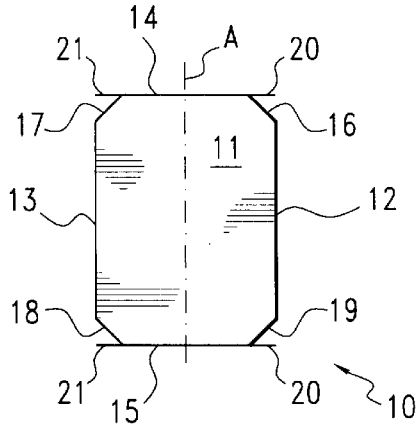
FIG.2 (PRIOR ART)
FIG. 2 is a schematic top plan view of the tray of FIG. 1.

A conventional eight sided container, e.g., a poultry tray, is depicted at 10 in FIGS. 1 and 2. The tray 10 comprises a bottom wall 11, opposite parallel side walls 12 and 13, opposite parallel end walls 14 and 15, and diagonal corner panels 16, 17, 18 and 19 connecting the side and end walls at adjacent ends. The diagonal corner panels extend at a 45° angle with respect to the longitudinal axis "A" of the tray. The width of the end walls 14 and 15 is such that they project at their opposite side edges 20, 21 beyond the diagonal corner panels, terminating at their outer edges in alignment with the plane of the side walls 12 and 13. The upper outer corners of the side edges 20, 21 are cut away at 22. Although not shown in these figures, a cover is typically placed on the tray. A plastic bag may also be inserted into the tray to receive the product (see FIG. 9, for example).

A first preferred embodiment of the container or tray of the invention is indicated generally at 30 in FIGS. 3–6. In this form of the invention two diagonally opposite corners 31 and 32 of the tray are squared, producing a six sided tray having two parallel side walls 33 and 34, two parallel end walls 35 and 36, a bottom wall 37, two opposed diagonal corner panels 38 and 39, and the two diagonally opposed square corners 31 and 32. With this arrangement the tray resists distortion, especially at the open top edge, when a lateral force is applied to the sides or ends of the tray. Better and more reliable cover fit is also obtained, and it also has significantly greater crush or stacking strength than a comparably sized four sided tray.

Figure 3:
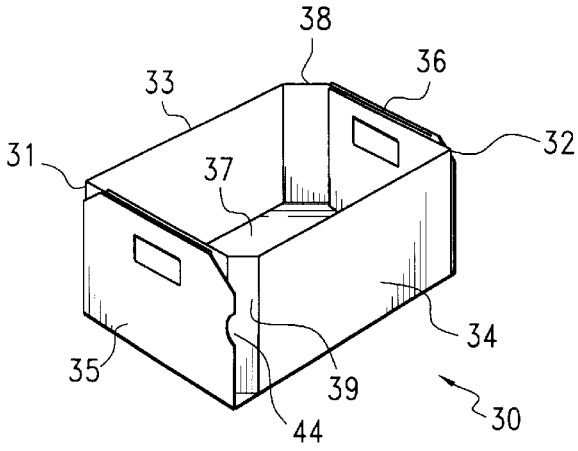
FIG. 3 is a top perspective view of a first embodiment of the invention, comprising a six sided poultry tray configured for machine set up, in which two diagonally opposed corners of the tray are square and the remaining two corners are diagonal panels.
Figure 4:
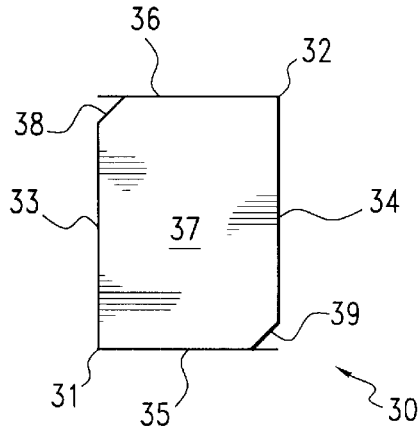
FIG. 4 is a schematic top plan view of the six sided tray of FIG. 3.
Figure 5:
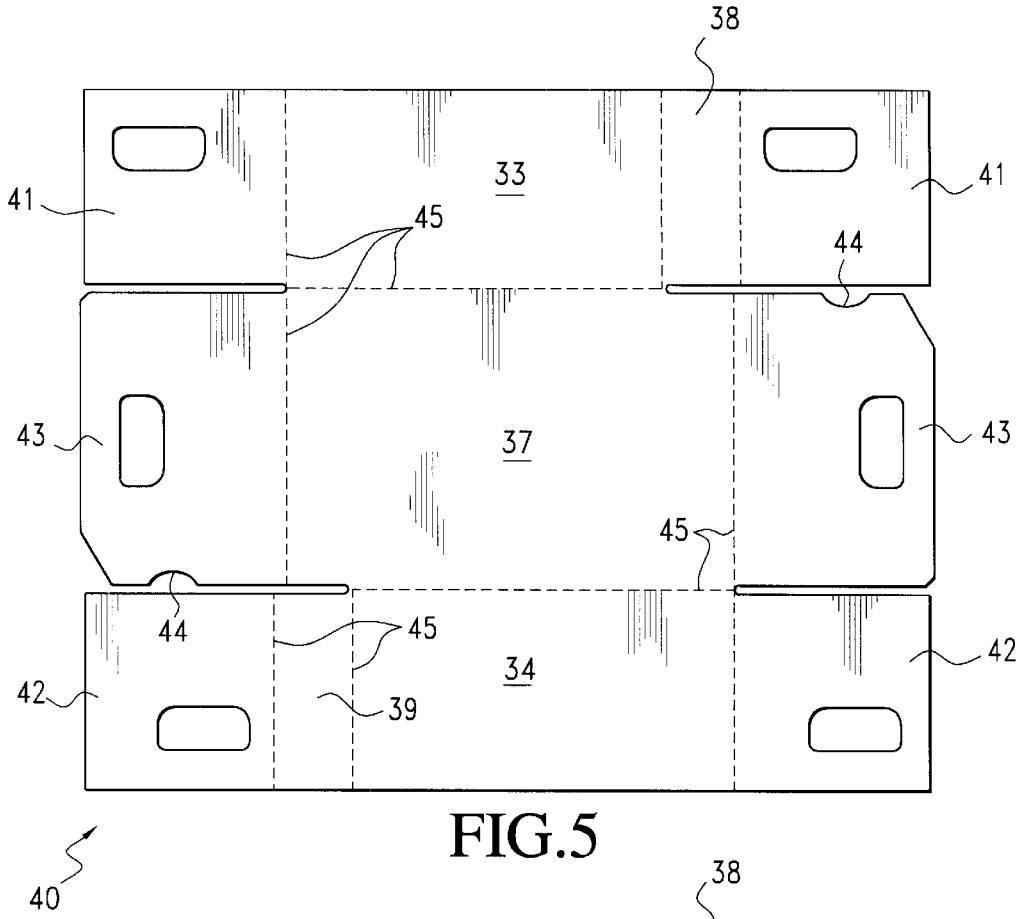
FIG. 5 is a plan view of a blank for making the six sided tray of FIG. 3, in which the end panels are overlapping.

In the particular form shown in FIGS. 3 and 5, the six sided tray is configured for machine set up. That is, the end panels 41, 42 and 43 at opposite ends of the blank 40 (see FIG. 5) are glued to one another in a machine operation to produce the tray shown in FIG. 3. The respective panels and walls are joined to adjacent structures via fold lines, indicated by the dashed lines 45.

It will be noted that notches 44 are formed in one side edge of each of end panels 43. These notches form a bag cuff grab which catches and holds the cuff "C" of a bag "B" placed in the tray, see FIG. 9, to hold the bag in place and facilitate filling of the bag. In other respects, the tray is constructed substantially the same as the tray shown in FIG. 1.

Figure 6:
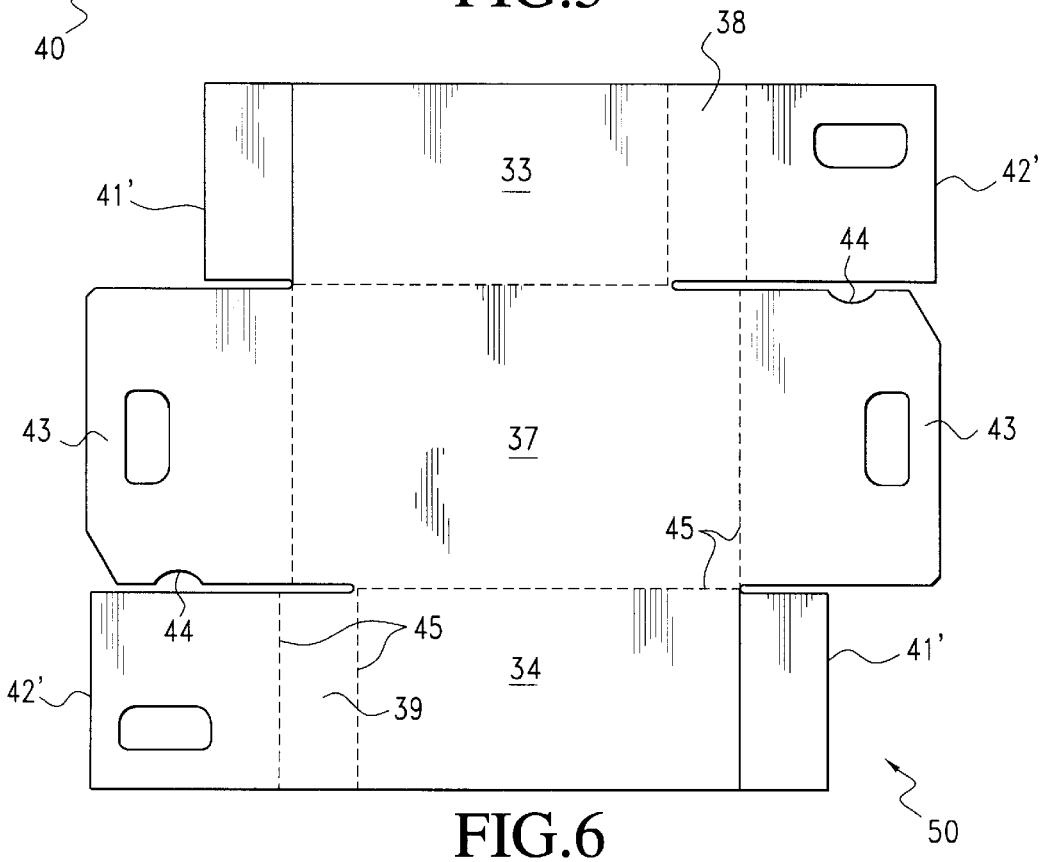
FIG. 6 is a plan view of a blank for making a first modification of the first embodiment of tray shown in FIG. 3, in which the end panels that form the end walls are non-overlapping.
Figure 10:
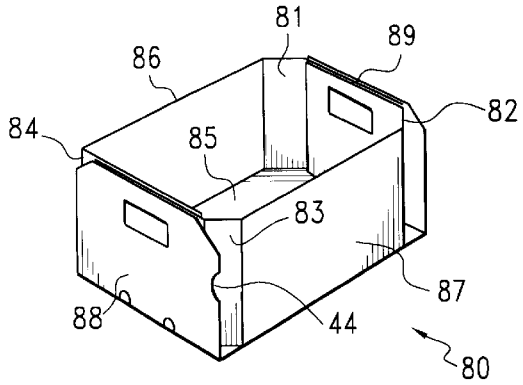
FIG. 10 is a top perspective view of a second embodiment of the invention, wherein the container has seven sides, with one square corner, and in this figure is configured for machine set up.
Figure 11:
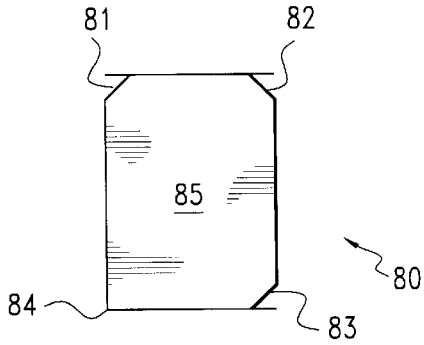
FIG. 11 is a schematic top plan view of the seven sided tray of FIG. 10.
Figure 12:
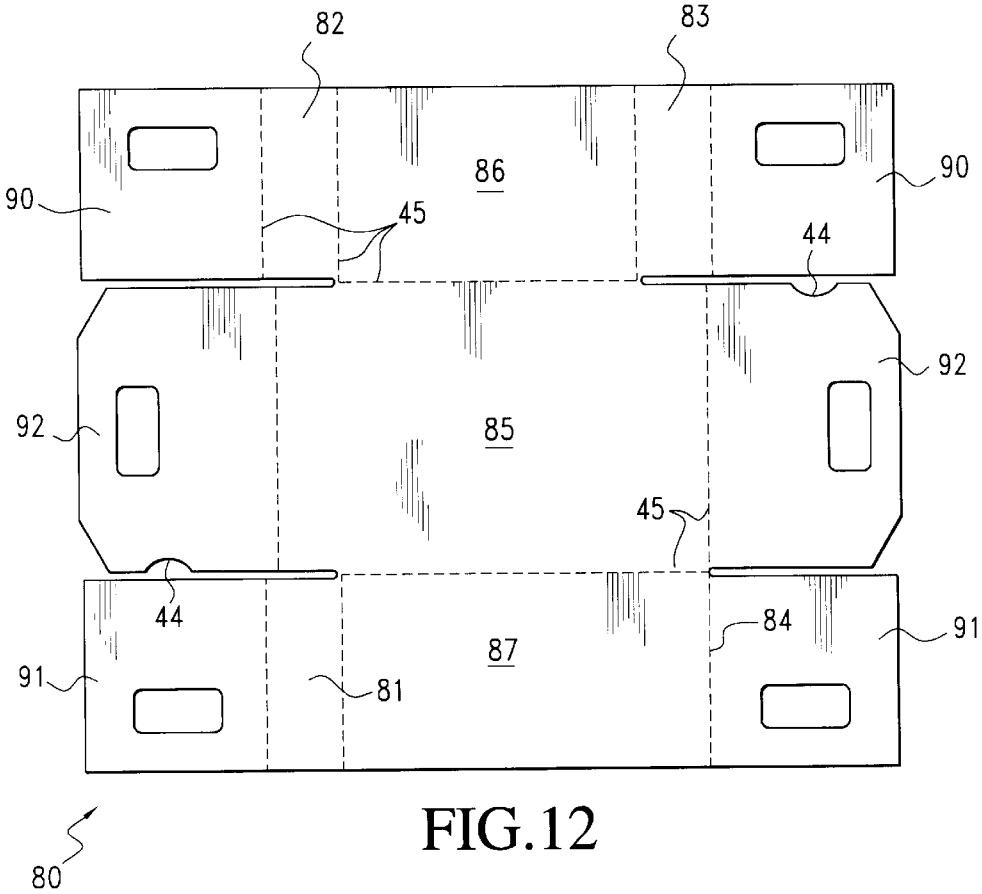
FIG. 12 is a plan view of a blank for making the seven sided tray of FIG. 10.

An alternate form of the six sided tray of the first embodiment is depicted at 50 in FIG. 6. The tray in this form of the invention is also configured for machine set up, but the end panels 41' and 42' do not overlap with one another. In other respects, the tray shown in this figure is essentially the same as that illustrated in FIGS. 3 and 5.

Another alternate form of the first embodiment is indicated generally at 60 in FIGS. 7–9. In this form of the first embodiment, the container or tray is configured for manual set up, and has a bottom wall 61, opposite parallel side walls 62 and 63, opposite parallel end walls 64 and 65, an opposed pair of diagonal corner panels 66 and 67, and two diagonally opposed square corners 68 and 69.

As seen best in FIG. 8, the container of FIG. 7 is erected from a unitary paperboard blank having overlapped end panels 70, 71 and 72 that form the end walls 64 and 65, and which are held in assembled relationship by a self locking arrangement comprising interengaged notches 73 and 74 in the top edges of the panels 70 and 71, and a roll-over flap 75 on the top edge of panel 72.

As in the previous form, a notch 44 may be formed in one side edge of each end panel 72 to form a grab for the bag cuff "C" of a bag "B" placed in the container, see FIG. 9, and the panels and walls are joined to one another along fold lines indicated by the dashed lines 45.

The six sided container of the first embodiment provides greater stacking strength than conventional four sided containers, and much greater resistance to distortion than conventional eight sided containers. In addition, a better and more reliable cover fit is obtained, and it is easier to achieve machine conversion from four sided to six sided than from four sided to eight sided. Further, the square corners in the six sided container give the ability to apply a label around the corner so that it is visible from two adjoining sides of the container.

A second embodiment of the invention is indicated at 80 in FIGS. 10–14, wherein the container has seven sides. In a first form of this embodiment, shown in FIGS. 10–12, the container is configured for machine set up, and has three corners 81, 82 and 83 oriented diagonally and only one corner 84 that is squared, producing a seven sided container. In all other respects, this embodiment is essentially the same as that shown in FIGS. 3 and 5. The container 80 has a bottom wall 85, opposed parallel side walls 86 and 87, opposed parallel end walls 88 and 89, diagonal corner panels 81, 82 and 83, and the single square corner 84. As seen best in FIG. 12, which depicts the unitary paperboard blank from which the container 80 is erected, the end walls each comprise end panels 90, 91 and 92, which are overlapped and glued together by machine in setting up the container.

A first modification of the second embodiment is shown at 100 in FIGS. 13 and 14. In this modification, the container is configured for manual set up, and to that end has notches 101 and 102 in the top edges of end panels 103 and 104, which interlock with roll over flap 105 on the top edge of end panel 106, as in the embodiment of FIGS. 7 and 8. In all other respects, this form is the same as that shown in FIGS. 10–12.

The seven sided container of the second embodiment of the invention has greater stacking strength than a conventional four sided container, resists distortion better than a conventional eight sided container, and in addition, provides a corner to which a label can be applied that is visible on two adjoining sides of the container.

A third embodiment of the invention is shown in FIGS. 16–21, wherein the container has eight sides, and the four diagonal corner panels are each oriented at an angle of 38° with respect to the longitudinal axis of the container.

Figure 17:
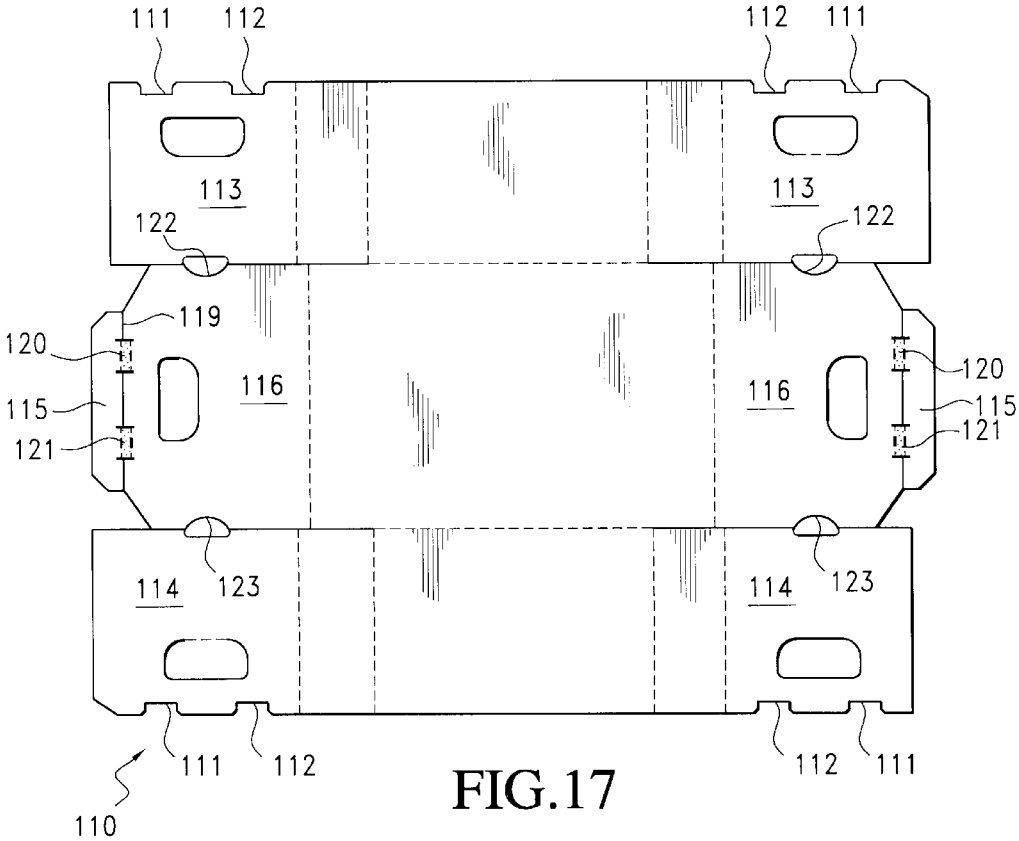
FIG. 17 is a plan view of a blank for use in manually erecting the eight sided tray of FIG. 16, wherein the end panels overlap.
Figure 18:
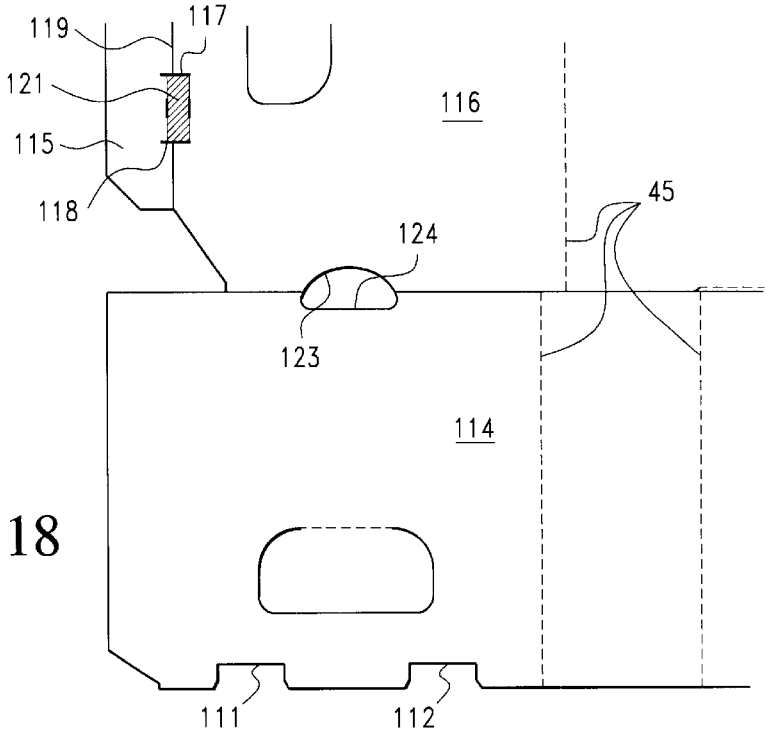
FIG. 18 is an enlarged fragmentary plan view of a portion of the blank of FIG. 17, showing details of construction.

In a first form of this third embodiment, depicted at 110 in FIGS. 17 and 18, the container is configured for manual set up and to that end has notches 111 and 112 in the top edges of end panels 113 and 114 that interlock with a roll over flap 115 on the top edge of end panels 116. Pairs of cuts 117 and 118 are made transversely across the cut line 119 between the roll over flap 115 and its associated end panel 116, and these cuts are spaced apart a distance approximately the same as the width of the notches 111 and 112 in panels 113 and 114. The cuts define short, narrow webs 120 and 121, which connect the roll over flap to its associated end panel, and in a preferred form, the webs are crushed from the inside of the container. Thus, when the roll over flap is folded inwardly over the top edge of the overlapped end panels, the webs extend more deeply and smoothly into the notches, forming a tight joint that effectively resists dislodgement.

Notches 122 and 123 are formed in opposite side edges of end panels 116, forming a bag cuff grab as in previous embodiments, but in this form of the invention, the notches 122 and 123 also extend a short distance at 124 into the adjacent edges of the panels 113 and 114, which, when the container is erected, form the bottom edge of those panels.

Figure 19:
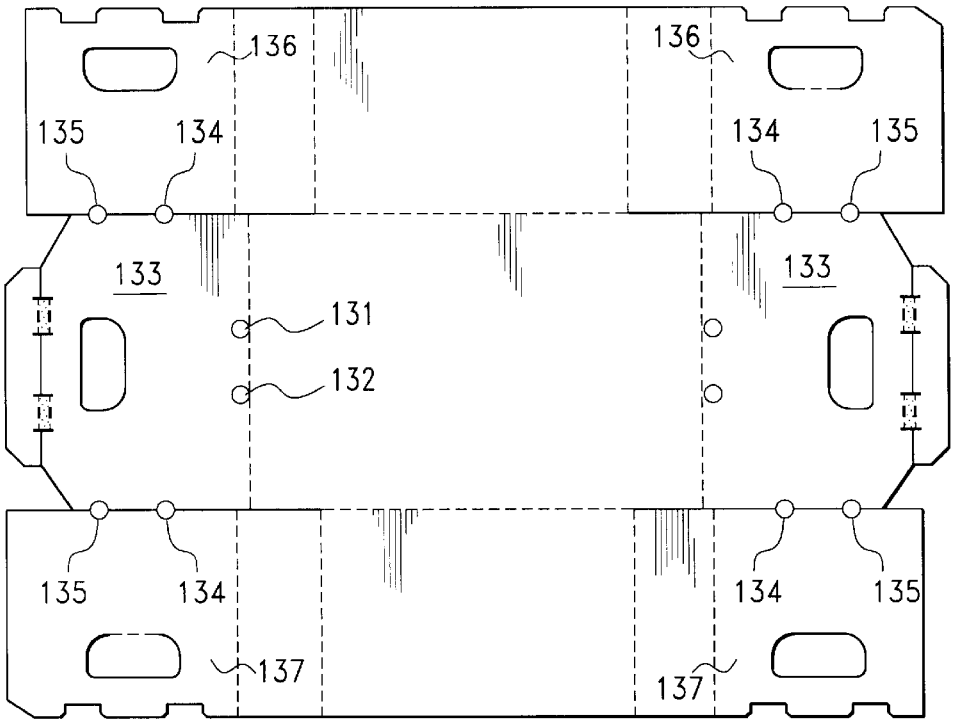
FIG. 19 is a plan view of a modified blank for manually erecting the eight sided tray, in which drain openings are provided for draining moisture from the tray when it is used to pack ice with the product.

A second form of the third embodiment is indicated at 130 in FIG. 19. In this form of the invention, the container is configured for manual set up, as in the previous form, and has drain openings 131 and 132 formed at the bottom edge of the center end panels 133. Cuts 134 and 135 are also made in the adjacent edges of the end panels 136, 137 and the center panel 133. These cuts form openings in the bottom edges of panels 136 and 137 when the container is erected, and these openings are in alignment with the openings 131 and 132, thus forming drain openings through the bottom edge of the end walls in the erected container. If desired, the cuts forming the drain openings can be extended into the edge of the adjacent end panel to also form bag cuff grab notches in the edges of the center panel when the container is erected. In other respects, this form of the invention is essentially the same as in the previous form.

Figure 20:
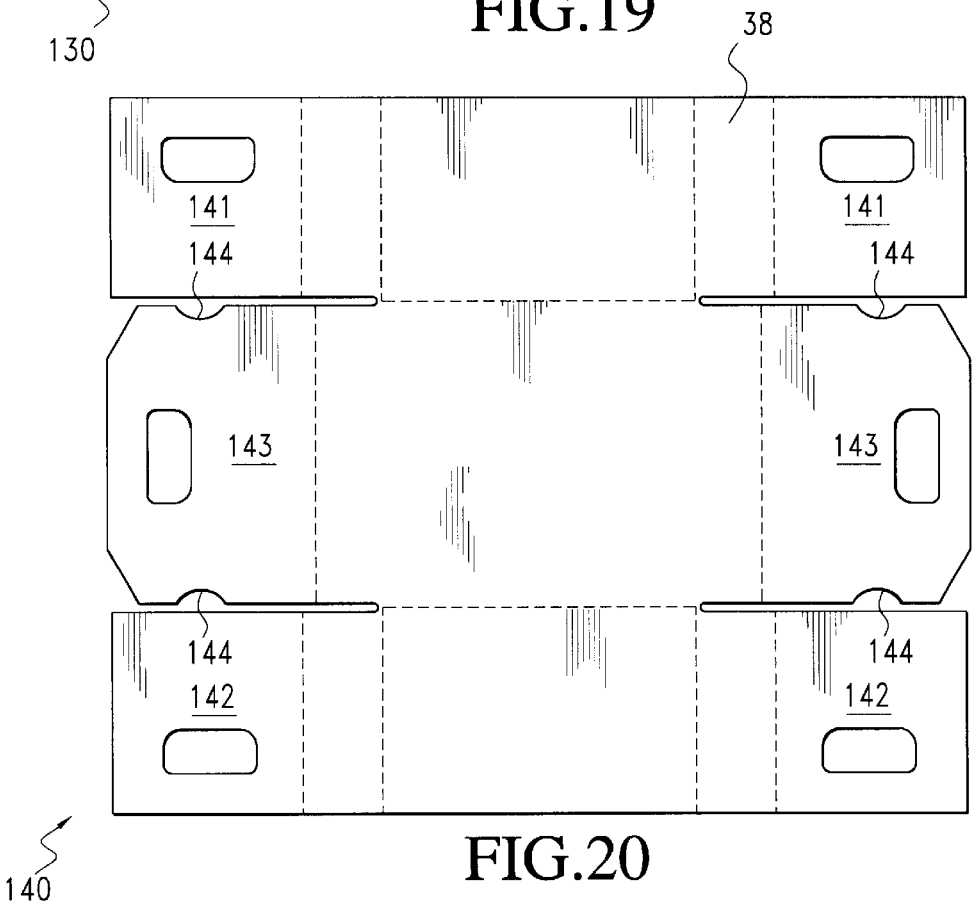
FIG. 20 is a plan view of a blank for use in machine set up of the eight sided tray, wherein the end panels overlap.

A third form of the third embodiment is indicated at 140 in FIG. 20. In this form, the container is more closely related to that form shown in FIG. 17, but is configured for machine set up. Thus, there is no self locking feature. Instead, the end panels 141 and 142 are overlapped with and glued to respective end panels 143 in a machine operation. Notches 144 in the sides of panels 143 function as bag cuff grabs as in the previous embodiments.

Figure 21:
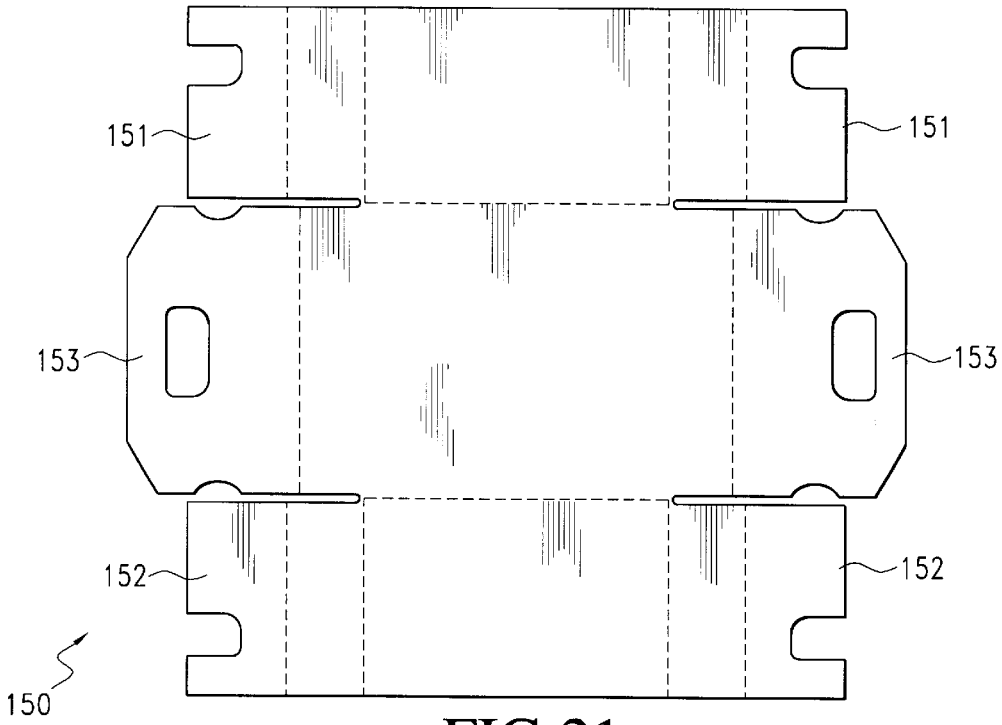
FIG. 21 is a plan view of a modified blank for use in machine set up of the eight sided tray, wherein the end panels do not overlap.

A fourth form of the third embodiment is indicated at 150 in FIG. 21. In this form, the container is also configured for machine set up, as in the FIG. 20 embodiment, but the end panels 151 and 152 do not overlap with each other, but partially overlap the center end panel 153 in the erected container. In other respects, this form of the invention is essentially the same as than in FIG. 20.

Figure 15:
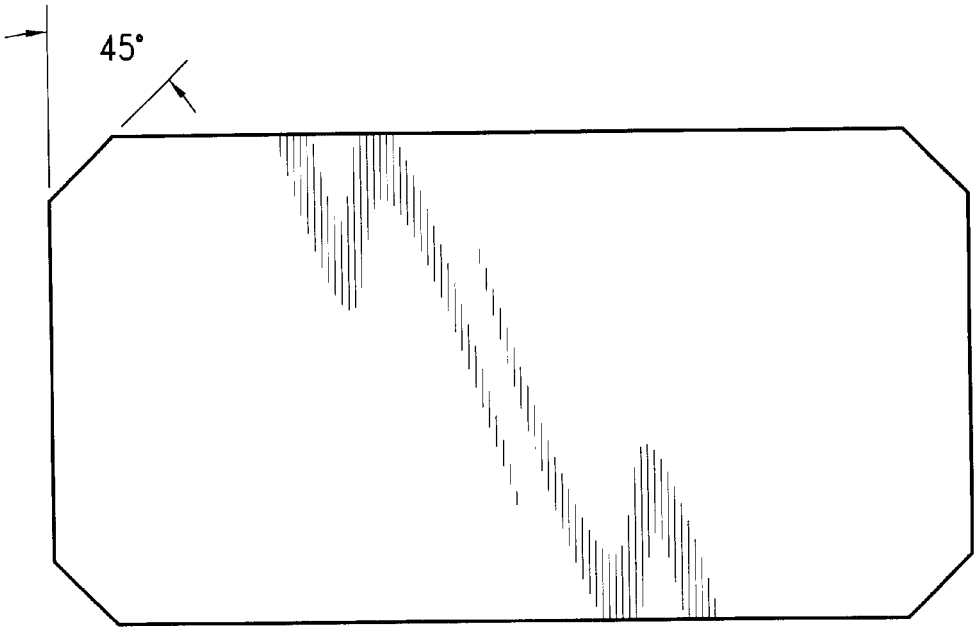
FIG.15 (PRIOR ART)
FIG. 15 is a schematic top plan view of a conventional eight sided tray, with the diagonal corner panels disposed at a 45° angle with respect to the longitudinal axis of the tray.
Figure 16:
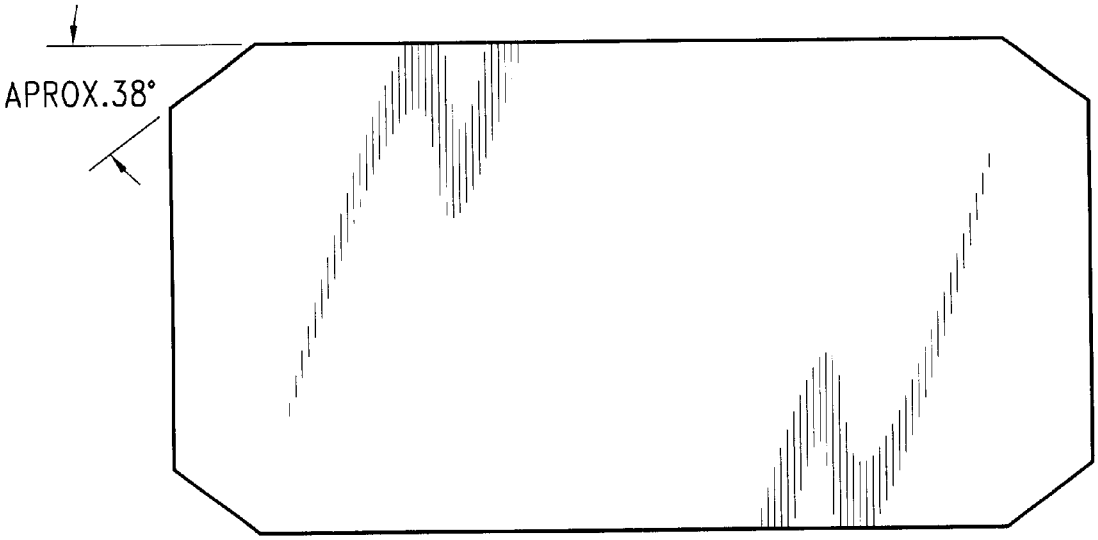
FIG. 16 is a schematic top plan view of a third embodiment of the invention, wherein the diagonal corner panels in an eight sided tray are disposed at an angle of 38° with respect to the longitudinal axis of the tray.

The more axial orientation of the diagonal corner panels in the various forms of the third embodiment of the invention described above, i.e., 38° rather than 45° as in conventional eight sided containers, produces a more axially oriented resultant force vector. Thus, lateral force exerted against the ends of the container are more effectively resisted than in conventional eight sided containers. Consequently, the container in this embodiment of the invention is more resistant to distortion when lateral forces are applied against it. It is therefore easier to apply a cover, and there is less likelihood that a cover on the container will be dislodged during handling of the container. Moreover, in this form of the invention the diagonal corner panels are wider and the side panels are shorter than in conventional eight sided containers, with comparable or even improved stacking strength. Compare FIGS. 15 and 16.

Figure 22:
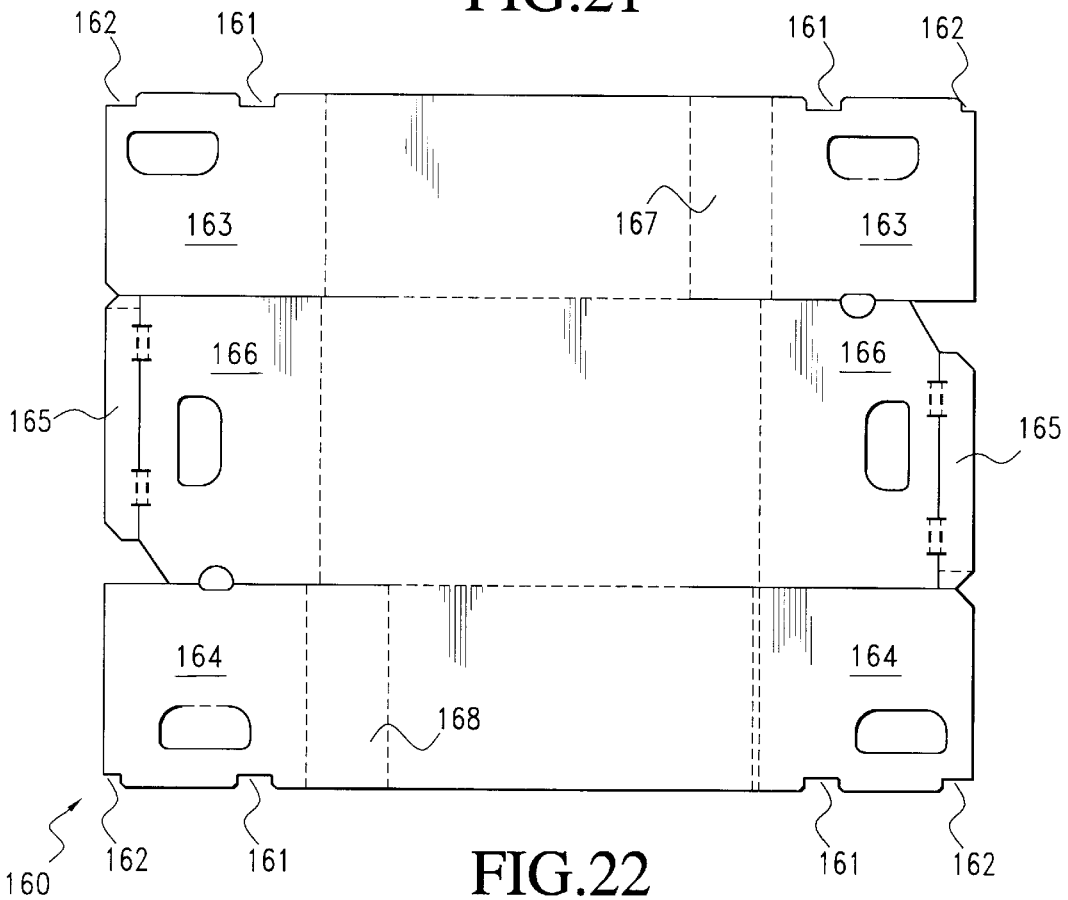
FIG. 22 is a plan view of a blank for use in manually setting up a fourth embodiment of a tray according to the invention, wherein the diagonal corner panels are oriented at an angle of 38° with respect to the longitudinal axis of the tray.
Figure 23:
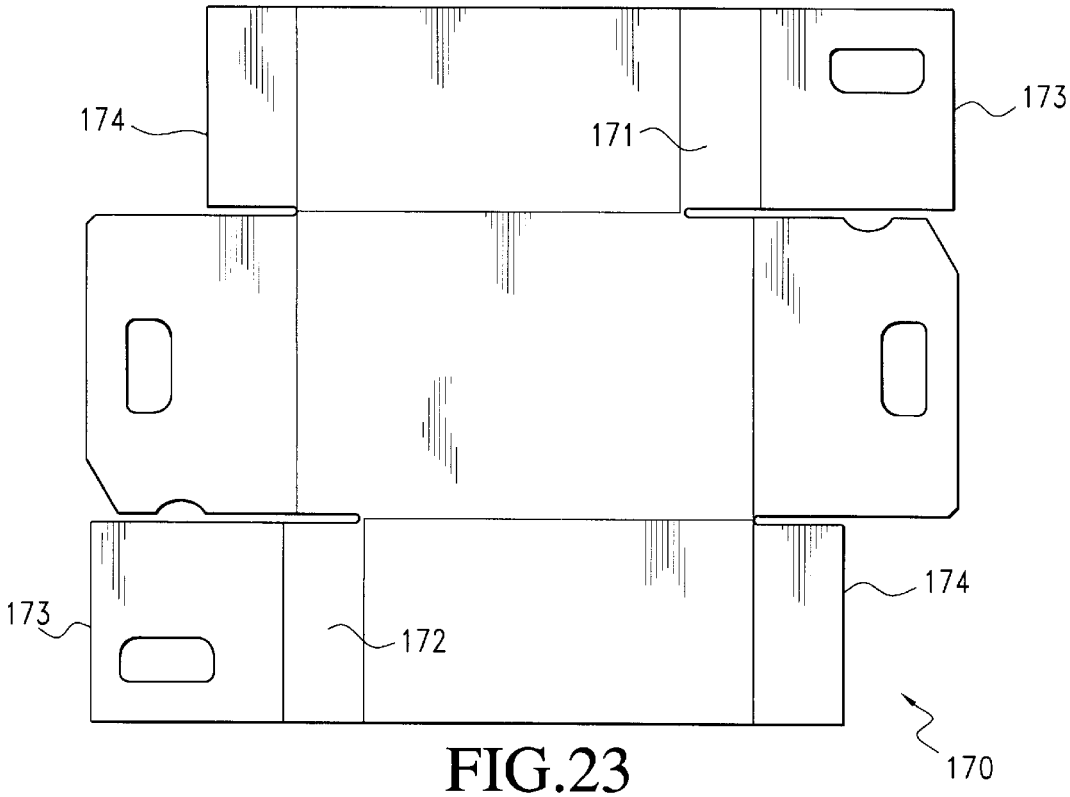
FIG. 23 is a plan view of a blank configured for machine set up of the six sided tray with the diagonal corner panels oriented at 38°, and wherein the end panels do not overlap.
Figure 24:
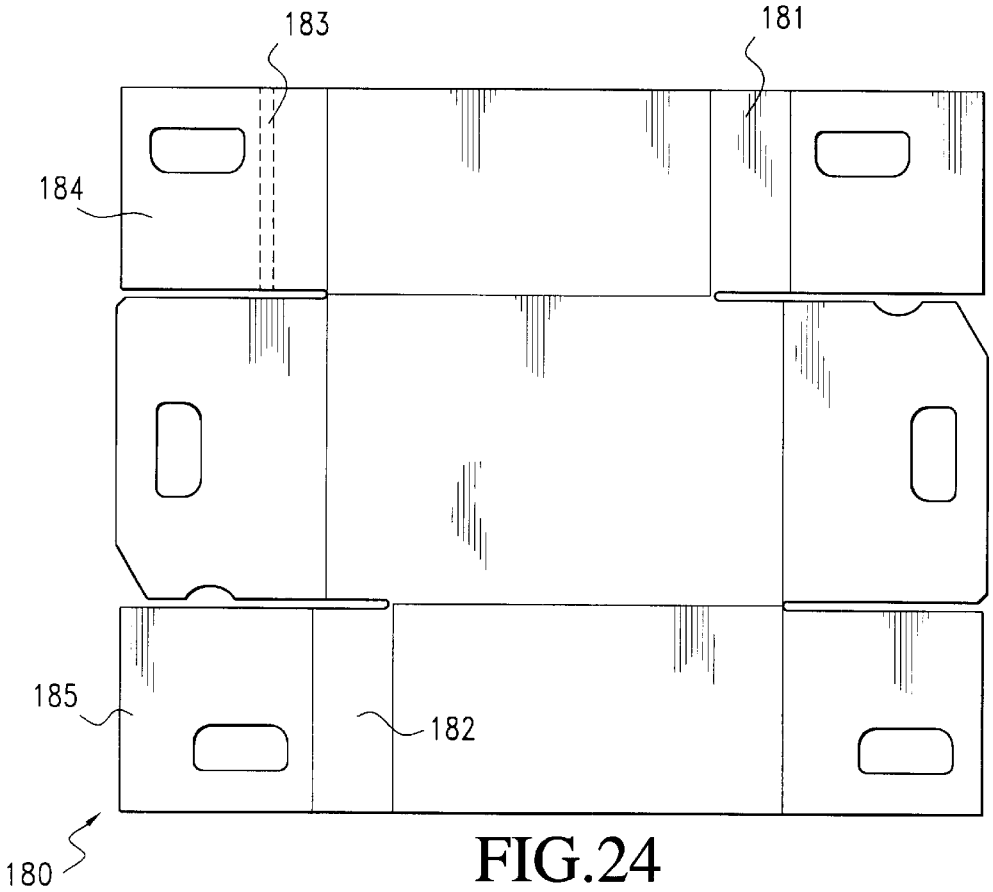
FIG. 24 is a plan view of a blank configured for machine set up of the fourth embodiment, wherein the end panels partially overlap.

A fourth embodiment of the invention is illustrated in FIGS. 22–24, wherein the container has six sides, with two square corners, and the diagonal corner panels are oriented at 38° with respect to the longitudinal axis of the container. This embodiment of the invention closely resembles that embodiment shown in FIGS. 3–8, except for the different angular disposition of the diagonal corner panels.

In a first form of the fourth embodiment, shown in FIG. 22, the container 160 is configured for manual set up as in previously described forms of the invention, and to this end has a pair of spaced notches 161 and 162 in the upper edges of end panels 163 and 164 for cooperation with a roll over flap 165 on the upper edge of end panel 166. The 38° orientation of the diagonal corner panels 167 and 168 results in these panels being wider than in the previous embodiment, achieving comparable or improved stacking strength and even greater resistance to distortion from force applied longitudinally to the container than is achieved with the previously described six sided container. In other respects, this form of the invention is essentially the same as that illustrated and described in relation to FIGS. 3–8, 17 and 18.

A second form of the fourth embodiment is indicated at 170 in FIG. 23. This form is substantially the same as that shown in FIG. 6, except that the diagonal corner panels 171 and 172 are oriented at 38° with respect to the longitudinal axis of the container. It is configured for machine set up, and the end panels 173 and 174 do not overlap with one another in the erected container.

A third form of the fourth embodiment is indicated at 180 in FIG. 24. This form is generally the same as that shown in FIG. 5, except that the diagonal corner panels 181 and 182 are oriented at an angle of 38° with respect to the longitudinal axis of the container, and a partially crushed area 183, or lines of perforations, are formed in end panel 184 to introduce some flexibility where the edge of panel 185 overlaps panel 184. This permits the panels to lie flat with minimum "ramping" effect.

Although only a six sided container with the diagonal corner panels oriented at 38° has been specifically illustrated and described, it should be understood that the diagonal corner panels in the seven sided container could also be oriented at 38°. Moreover, the angle of the corner panels in the invention need not be exactly 38°, but could be in the range of from about 35° to about 40°, although the angle of 38° is preferred.

Although particular embodiments of the invention are illustrated and described in detail herein, it is to be understood that various changes and modifications may be made to the invention without departing from the spirit and intent of the invention as defined by the scope of the appended claims.

What is claimed is:

1. In a multi-sided container having opposite side walls, opposite end walls, a longitudinal axis, and at least two diagonal corner panels oriented at an angle of 38° with respect to the longitudinal axis of the container, the improvement comprising:

at least one said side wall and an adjacent said end wall disposed orthogonally with respect to one another and connected to define a square corner, said square corner serving to resist distortion of the container when a force is applied laterally against the sides or ends of the container, and the diagonal corner panels providing stacking strength for containers stacked on top of one another.

2. A container as claimed in claim 1, wherein:

the container has six sides, including said side walls and end walls, and said two diagonal corner panels, and there are two diagonally opposite square corners.

3. A container as claimed in claim 2, wherein:

the container end walls each comprise a plurality of overlapping end panels having upper edges with interlocking means thereon so that the panels may be manually engaged with one another and interlocked for manual erection of the container.

4. A container as claimed in claim 1, wherein:

the container has seven sides, including said side and end walls, and three diagonal corner panels, and there is one square corner.

5. A container having opposite side walls, opposite end walls, a longitudinal axis, and a plurality of diagonal corner panels, the improvement comprising:

said diagonal corner panels being oriented so that they subtend an angle of from about 35° to about 40° with respect to the longitudinal axis of the container, thereby providing a resultant force vector that is axially oriented to resist distortion of the container when a force is exerted against the ends of the container, and also providing stacking strength when the containers are stacked on top of one another.

6. A container as claimed in claim 5, wherein:

the diagonal corner panels subtend an angle of 38° with respect to the longitudinal axis of the container.

7. A container as claimed in claim 6, wherein:

the container has eight sides, including said side and end walls, and four diagonally opposed diagonal corner panels.

8. A container as claimed in claim 6, wherein:

the container has six sides, including said side and end walls, and two diagonally opposed diagonal corner panels, and there are two diagonally opposed square corners.

9. A container as claimed in claim 6, wherein:

the container has seven sides, including said side and end walls, and three diagonally opposed diagonal corner panels, and there is one square corner.

* * * * *